United States Patent [19]

Wootten

[11] 4,423,555

[45] Jan. 3, 1984

[54] DEVICE FOR MEASURING CUTS IN WALL PANELING AND THE LIKE

[76] Inventor: Doyle F. Wootten, R.D. #1, Box 3, Magnolia, Del. 19962

[21] Appl. No.: 306,007

[22] Filed: Sep. 28, 1981

[51] Int. Cl.[3] ..... G01B 3/14

[52] U.S. Cl. ..... 33/174 G; 33/DIG.10; 33/180 R

[58] Field of Search ..... 33/174 G, DIG. 10, 180 R, 33/452, 454, 456, 459, 460, 461, 462, 194, 416

[56] References Cited

U.S. PATENT DOCUMENTS

| | | | |
|---|---|---|---|
| 697,090 | 4/1902 | Keef | 33/194 |
| 820,448 | 5/1906 | Turdin | 33/456 |
| 3,242,580 | 3/1966 | Crawford | 33/174 G |
| 3,672,064 | 6/1972 | Elkins et al. | 33/180 R |
| 3,842,510 | 10/1974 | Elliott | 33/174 G |
| 4,285,135 | 8/1981 | Minozzi, Jr. | 33/DIG. 10 |

*Primary Examiner*—Willis Little
*Attorney, Agent, or Firm*—Mortenson & Uebler

[57] ABSTRACT

A new device is provided for measuring where to make cuts for electrical outlets, windows, etc. in wall paneling. Exact locations of the cuts to be made are determined using this device which comprises an upper body member detachably affixed to a lower body member, each body member having an upper and a lower arm assembly. The body and arm members are preferably of aluminum stock and are fastened together with copper coated rivets. The measuring device of this invention can be placed on a wall to be paneled and the body and arm members positioned at the location of wall intersections or junctions and electrical outlets, windows, etc., respectively. The entire device so positioned can then be easily transported to the panel to be cut, the appropriate cutouts can be exactly marked on the panel, and the exact cuts needed are then easily made. The rivets holding the assembly together are such that sufficient force is exerted at each joint to prevent substantial movement of joints in transportation of the device from wall site to the panel to be cut, yet each joint is readily adjustable and moveable to allow precise positioning of the components at the desired locations at the wall site.

9 Claims, 4 Drawing Figures

DEVICE FOR MEASURING CUTS IN WALL PANELING AND THE LIKE

BACKGROUND OF THE INVENTION

1. Field of the Invention

This invention relates to a device for precisely measuring where cuts should be made in wall paneling and the like to provide for electric outlets and switches, windows, steps and other required cutouts.

2. Description of the Prior Art

Various devices are known in the engraving and lettering art having arms and scribes for tracking or tracing objects. Exemplary are the devices disclosed in U.S. Pat. Nos. 3,909,947; 3,721,008; 3,714,713; 3,555,686; 3,295,211; 3,290,783 and 1,351,476.

Devices are known in the roofing and siding art having arms, guides and/or scribes to aid in the installment of shingles, siding or shakes. Exemplary of such prior devices are disclosed in U.S. Pat. Nos. 4,089,141; 1,954,213 and 1,405,083.

None of these prior devices, either alone or in combination, disclose or suggest the invention claimed herein, nor is any other art known which is more relevant or pertinent to this invention than that set forth above.

SUMMARY OF THE INVENTION

A device is provided for accurately measuring the locations of cuts in wood or similar paneling needed to accomodate windows, electrical switches and outlets, stairs and the like comprising:

(a) an upper body member detachably affixable to (b) a lower body member, each of the upper and lower body members having attached thereto (c) an upper arm assembly and a lower arm assembly, each arm assembly comprising (i) an interior arm member pivotally attached at one end to the body member and, at the other end, to (ii) a middle arm member pivotally attached, in turn, to (iii) an exterior arm member.

The body and arm members are preferably aluminum bar stock.

The upper body member preferably has a slot along its length and the lower member has at least two bolts attached that extend through the slot and into the wing nuts and washers to affix the upper body member to the lower body member at a desired extension.

Each exterior arm member preferably has openings suitable for attaching desired templates and the like thereto by screw means.

DETAILED DESCRIPTION OF THE INVENTION AND PREFERRED EMBODIMENTS WITH REFERENCE TO THE DRAWINGS

A new device is provided for measuring where to make cuts for electrical outlets, windows, etc. in wall paneling. Exact locations of the cuts to be made are determined using this device which comprises an upper body member detachably affixed to a lower body member, each body member having an upper and a lower arm assembly. The body and arm members are preferably of aluminum stock and are fastened together with copper coated rivets. The measuring device of this invention can be placed on a wall to be paneled and the body and arm members positioned at the location of wall intersections or junctions and electrical outlets, windows, etc., respectively. The entire device so positioned can then be easily transported to the panel to be cut, the appropriate cutouts can be exactly marked on the panel, and the exact cuts needed are then easily made. The rivets holding the assembly together are such that sufficient force is exerted at each joint to prevent substantial movement of joints in transportation of the device from wall site to the panel to be cut, yet each joint is readily adjustable and moveable to allow precise positioning of the components at the desired locations at the wall site.

A detailed description of the invention is best provided by referring to the accompanying drawings.

Figure 1:
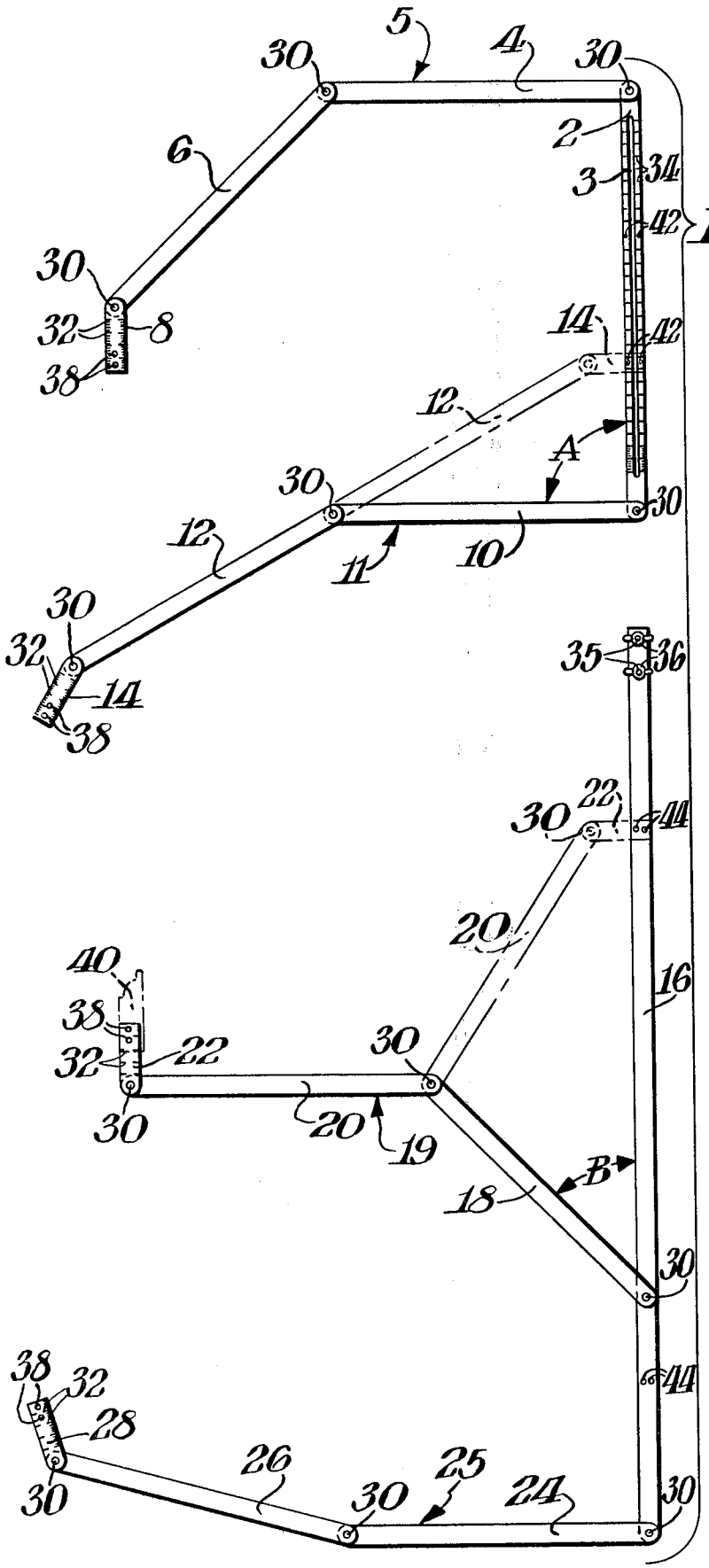
FIG. 1 is a side elevation of the measuring device of this invention wherein the upper body member and arms are shown detached from the lower body member and arms.

FIG. 1 shows, in side elevation, the measuring device of this invention wherein the upper body member 2 is shown detached from lower body member 16. Upper body member 2 has an upper arm assembly 5 pivotally attached to its upper end by rivet 30 and lower arm assembly 11 attached to its lower end by rivet 30 as shown. Each arm assembly comprises an interior arm member 4, 10, pivotally attached to middle arm member 6, 12, which, in turn, is pivotally attached to exterior arm member 8, 14. All joints are attached by means of rivets 30.

Upper body member 2 has a longitudinal slot 3 for securing to lower body member 16 by means of wing nuts 36. This fastening means will be discussed more fully below when describing FIG. 2.

Upper body member 2 has divisional markings 34, preferably in fractions of an inch, for length measuring purposes and exterior arm members 8, 14, 22 and 28 all have similar divisional markings 32.

Openings 38 are provided in arm members 8, 14, 22 and 28 which have a dual purpose. These openings can be used to secure a craftsman's template such as an electrical outlet template or a telephone outlet template thereto. Also, in conjunction with cooperating openings 42 in body member 2, where holes 38 are aligned with holes 42 as shown in phantom and secured thereto, a desired angle "A" is formed by body members 2 and interior arm member 10. In a preferred configuration, angle "A" is 90° as shown.

Preferred dimensions of each segment of the apparatus of this invention are given below.

FIG. 1 also shows lower body member 16 having upper arm assembly 19 and lower arm assembly 25 pivotally attached to body member 16 by means of rivets 30. Each arm assembly, as for the upper body member, comprises an interior arm member 18, 24, pivotally attached to middle arm member 20, 26, which, in turn, is pivotally attached to exterior arm member 22, 28. All joints are attached by means of rivets 30.

Openings 38 are provided in exterior arm members 22 and 28 as discussed above for holding templates and the like and also for securing the arm members to lower body member 16 fixed at a desired angle. Template 40 is shown partially broken away for illustration. Arm assembly 19 is shown in phantom with openings 38 in exterior arm member 22 aligned with openings 44 in lower body member 16, thereby forming a desired angle "B" between lower body member 16 and interior arm member 18. In a preferred configuration, angle "B" is 45° as shown. Lower arm assembly 25 will form a 90° angle between lower body member 16 and interior arm member 24 where holes 38 in arm member 28 are in alignment with holes 44 in body member 16.

Arm members 22 and 28 also have divisional markings 32 thereon, preferably in fractions of an inch, for convenient length-measuring purposes.

Figure 2:
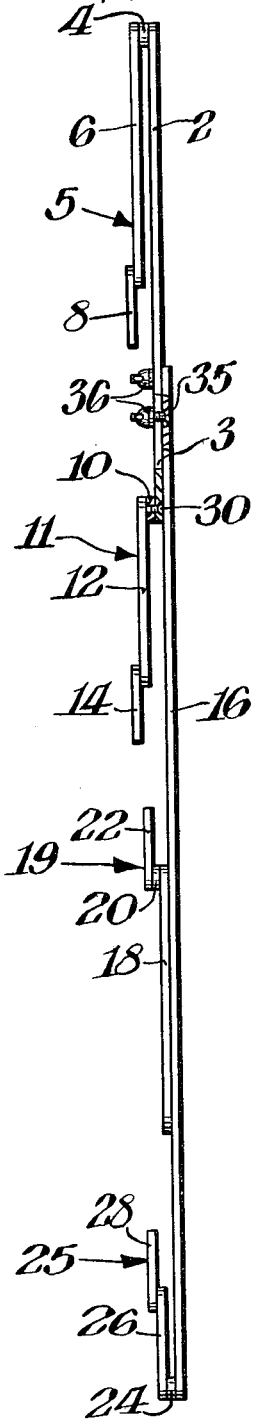
FIG. 2 is a front elevation of the measuring device wherein upper body member and arms are shown attached to the lower body member and arms.

FIG. 2 shows upper body member 2 attached to lower body member 16 by means of bolts 35 and wing nuts and washers 36. In the partial cross-section shown, the bolts 35 in lower body member 16 extend through slot 3 in upper body member 2 and into wing nuts and washers 36. Arm members 4, 6, 8, 10, 12, 14, 18, 20, 22, 24, 26 and 28 are all included for completeness and to compliment FIG. 1.

Rivet 30 is shown in cross-section in FIG. 2 connecting interior arm member 10 to upper body 2. All rivets 30 connect the various joints in a similar manner.

Figure 3:
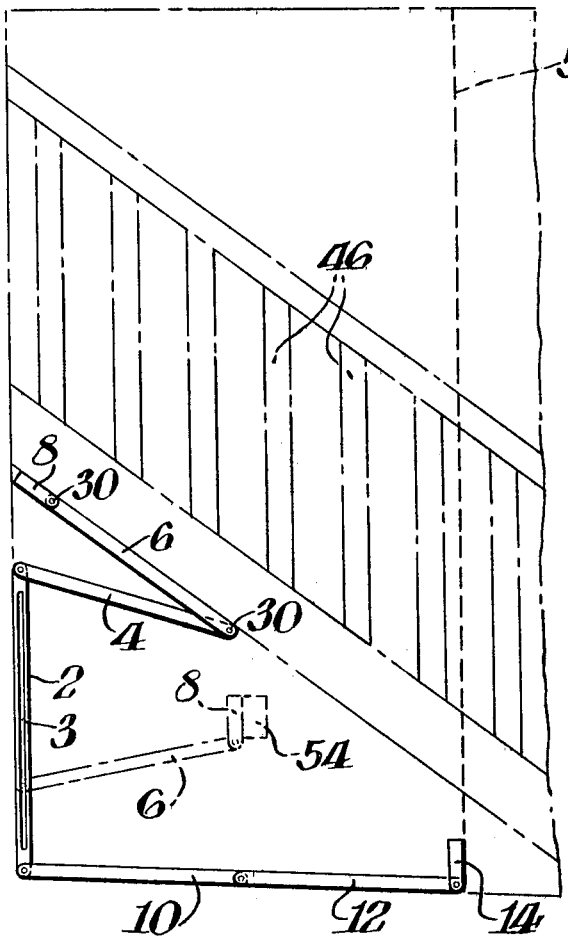
FIG. 3 is a side elevation of the meauring device of this invention in use to measure locations of cuts to accomodate stair casing, electrical outlet and out-of-plumb floor.
Figure 4:
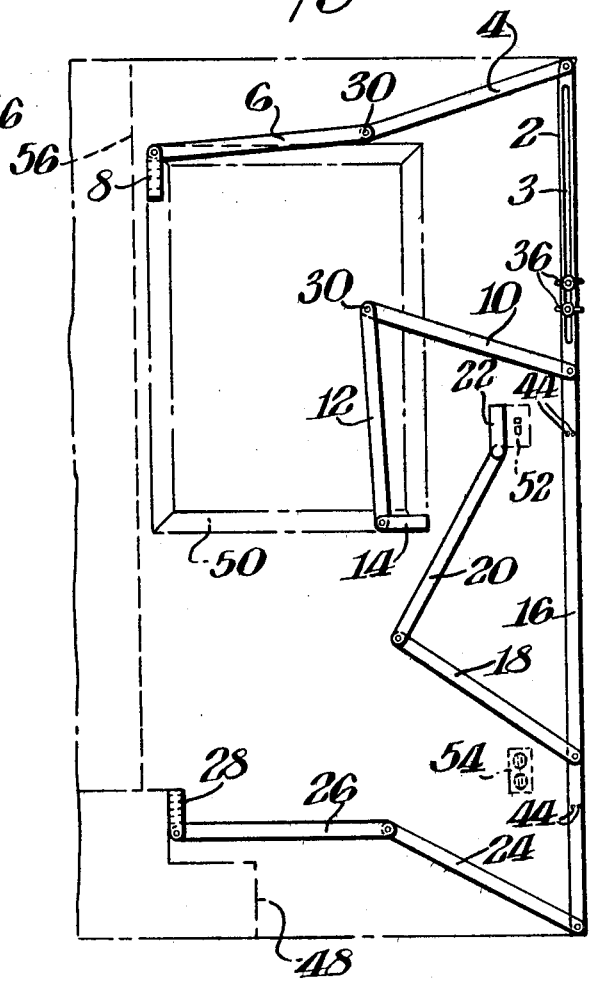
FIG. 4 is a side elevation of the device in use to measure the locations of cuts needed to accomodate a window, a step and an electrical switch.

FIG. 3 shows the upper body 2 and its two arm assemblys being used alone for convenience. Numeral 46 indicates a stair casing and numeral 56 is intended to indicate the edge of the next-adjacent wall panel. Upper body member 2 and its arm members are shown being used to measure the location of the angle of the stair case by arms 4, 6 and 8, the floor angle by arms 10, 12 (in old houses the floors are often out of plumb), all in relation to the adjacent wall determined by upper body member 2. Once the aforesaid locations have been determined and marked on the next panel to be cut, a second measurement can be made of the location of electrical outlet 54, using arms 4, 6 and 8 as shown, in phantom. Exterior arm 14 indicates where the next panel will start and this panel ends. FIG. 4 shows the entire device of this invention being used to determine the location of several cuts to be made in a panel to be installed on the wall shown. Upper body member 2 is secured to lower body member 16 at the desired height by means of wing nuts 36. The unit is shown placed at the corner wall and the total height indicates the length of the panel needed.

Topmost arms 4, 6 and 8 in combination with arms 10, 12 and 14 measure diagonal corners of windows 50. With these measurements, the entire window location can be scribed on the panel to be cut.

Arms 18, 20 and 22 measure the exact location of electrical switch 52. Arms 24, 26 and 28 measure the exact location of upper stair 48.

Once the above measurements have been scribed on the panel to be cut, a second measurement can be taken of the locations of electrical outlet 54 and lower step 48 as shown in FIG. 4.

All joints are preferably held together by copper coated rivets 30. These rivets are such that sufficient force is exerted at each joint to prevent substantial movement of the arms and/or body connected at the joint upon transportation of the device from the wall site to the panel to be cut, yet each joint is readily adjustable and moveable. If the joints become loose, they can be returned to the desired firmness by tapping the rivets with a hammer or the like.

Preferred dimensions of the various component parts of this invention are as shown below, where all dimensions are in inches.

| | |
|---|---|
| Upper body member 2 | $1\frac{1}{2} \times \frac{1}{8} \times 34\frac{1}{2}$ |
| Lower body member 16 | $1\frac{1}{2} \times \frac{1}{8} \times 72$ |
| Interior arm members (4, 10, 18, 24) | $1\frac{1}{4} \times \frac{1}{8} \times 24\frac{1}{2}$ |
| Middle arm members (6, 12, 20, 26) | $1\frac{1}{4} \times \frac{1}{8} \times 24\frac{1}{2}$ |
| Exterior arm members (8, 14, 22, 28) | $1\frac{1}{4} \times \frac{1}{8} \times 5\frac{1}{2}$ |
| Slot length (3) | 28 |

Each component is preferably made of aluminum bar stock. When the unit is closed and the arms folded, it is $77\frac{1}{2}$ inches long by $1\frac{1}{2}$ inches wide by about 2 inches thick.

While the invention has been described above in connection with certain specific details and embodiments, it will be clear to one skilled in the art that changes or modifications deviating from these specific embodiments may be made without deviating from the gist of this invention and such changes and modifications are deemed to fall within the scope of the claims below.

I claim:

1. A device for accurately measuring the locations of cuts in wood or similar paneling needed to accommodate windows, electrical switches and outlets, stairs and the like comprising:

(a) an upper body member, (b) a lower body member affixed to said upper body member, (c) an upper arm assembly and a lower arm assembly attachedto each of said upper and lower body members, each arm assembly comprising (i) an interior arm member pivotally attached at one end to said body member, (ii) a middle arm member pivotally attached at one end to the other end of said interior arm, and (iii) an exterior arm member pivotally attached to one end to the distal end of said middle arm member (d) all pivotal attachments being by rivets having sufficient force exerted at each joint to prevent substantial movement of said joints in transportation of the device, yet each joint being readily adjustable and moveable to allow precise positioning of the components at desired locations.

2. The device of claim 1 wherein said body and arm members are aluminum bar stock.

3. The device of claim 1 wherein said upper body member has a slot along its length and said lower body member has at least two bolts that extend through said slot and into wing nuts and washers to affix the upper body member to the lower body member.

4. The device of claim 1 wherein said exterior arm member has openings suitable for attaching desired templates and the like thereto by screw means.

5. The device of claim 1 wherein each body member has openings suitable for attaching said member to the wall site being measured using tacking means or the like.

6. The device of claim 1 wherein said body member(s) and said arm(s) have length scales inscribed thereon.

7. The device of claim 1 wherein the combined height of upper body member and lower body member is at least 8 feet and the combined extension of each interior arm member and middle arm member is at least 4 feet.

8. The device of claim 1 wherein said upper body member is detachably affixed to said lower body member.

9. A device for accurately measuring the locations of cuts in wood or similar paneling needed to accomodate windows, electrical switches and outlets, stairs and the like comprising:

(a) an upper body member, (b) a lower body member attached to each of said upper and lower body members, (c) an upper arm assembly and a lower arm assembly attached to each of said upper and lower body members, each arm assembly comprising (i) an interior arm member pivotally attached at one end to said body member, (ii) a moddle arm member pivotally attached at one end to the other end of said interior arm, and to (iii) an exterior arm member pivotally attached to one end to the distal end of said middle arm member, wherein each exterior arm member has openings suitable for attaching desired templates and the like thereto by screw means, and wherein said each body member has openings suitable for attaching said member to the wall site being measured using tacking means or the like, and wherein said openings in said exterior arms and said openings in said body members are located so as to form a desired angle by the interior arm member and said body member when said arm and body openings are in alignment (d) all pivotal attachments being by rivets having sufficient force exerted at each joint to prevent substantial movement of said joints in transportation of the device, yet each joint being readily adjustable and moveable to allow precise positioning of the components at desired locations.

* * * * *